United States Patent [19]

Bristow

[11] Patent Number: 4,659,296

[45] Date of Patent: Apr. 21, 1987

[54] ROTARY VANE PUMP WITH PLURAL OUTLET PORTS AND RELATIONSHIP FOR CAM SURFACE RADII

[75] Inventor: Ian T. Bristow, Higham, England

[73] Assignee: Hobourn-Eaton Limited, Rochester, England

[21] Appl. No.: 793,096

[22] Filed: Oct. 30, 1985

[30] Foreign Application Priority Data

Oct. 30, 1984 [GB] United Kingdom ..... 8427354

[51] Int. Cl.[4] ..... F01C 1/344

[52] U.S. Cl. ..... 418/15; 418/150; 418/225

[58] Field of Search ..... 418/15, 150, 225

[56] References Cited

U.S. PATENT DOCUMENTS

| | | | |
|---|---|---|---|
| 2,832,199 | 4/1958 | Adams et al. | 418/15 |
| 3,025,802 | 3/1962 | Browne | 418/225 |
| 3,066,608 | 12/1962 | Livermore | 418/15 |

*Primary Examiner*—John J. Vrablik

*Attorney, Agent, or Firm*—Wenderoth, Lind & Ponack

[57] ABSTRACT

The cam surface of a roller-type positive displacement pump providing an inlet port and two outlet ports has on circumferentially opposite sides of at least one of the outlet ports a profile such that the difference between the squares of the radii at the instantaneous points of contact therewith of the two rollers which serve to seal the port at said opposite sides is a constant. The portions of the cam surface at oposite sides of such an outlet port have radii relative to the axis of rotation of the rotor which decrease progressively in the direction of rotation of the rotor.

1 Claim, 2 Drawing Figures

ROTARY VANE PUMP WITH PLURAL OUTLET PORTS AND RELATIONSHIP FOR CAM SURFACE RADII

This invention relates to rotary pumps and more particularly concerns pumps of the kind comprising a housing accommodating a rotor provided with radial slots in which are mounted vanes, rollers or other forms of piston movable radially in the slots and engaging a circumferentially-extending cam surface provided internally of the housing, the housing further providing an inlet port and two or more outlet ports circumferentially spaced from each other and from the inlet port, so that rotation of the rotor causes fluid from the inlet port to be delivered to both or as the case may be all of said outlet ports.

According to the present invention, considering the two portions of said cam surface extending circumferentially on opposite sides of at least one of the outlet ports, the profiles of said two portions are such that as two pistons move along said two portions respectively, which pistons jointly determine the instantaneous delivery through said one outlet port, the difference between the squares of the radii of said two portions relative to the axis of rotation of the rotor at the instantaneous points of contact of said two pistons with the two portions respectively is a constant.

The two said radii may be constant, but in order to give improved sealing contact between the pistons and the cam surface it may be preferred in some cases to reduce the two radii progressively in the direction of rotation of the rotor.

The invention also provides a pump of the kind referred to wherein said cam surface where it extends between the inlet port and the next adjacent outlet port in the direction of rotation of the rotor and/or between at least one pair of next adjacent outlet ports is circular in profile and is centred on the axis of rotation of the rotor.

In preferred constructions according to the invention, the part of the cam surface extending circumferentially between each port and each of the two next adjacent flanking ports is circular in profile and is centred on the axis of rotation of the rotor.

Figure 1:
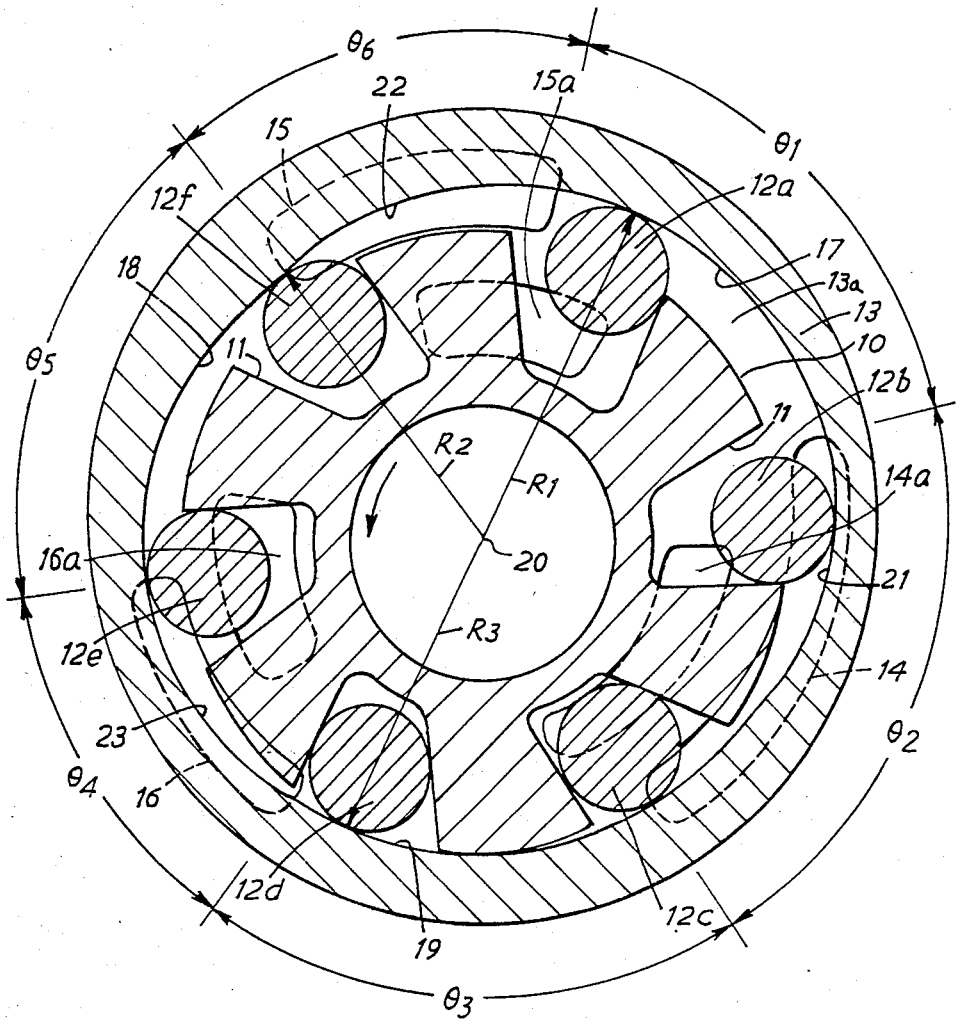
Figure 2:
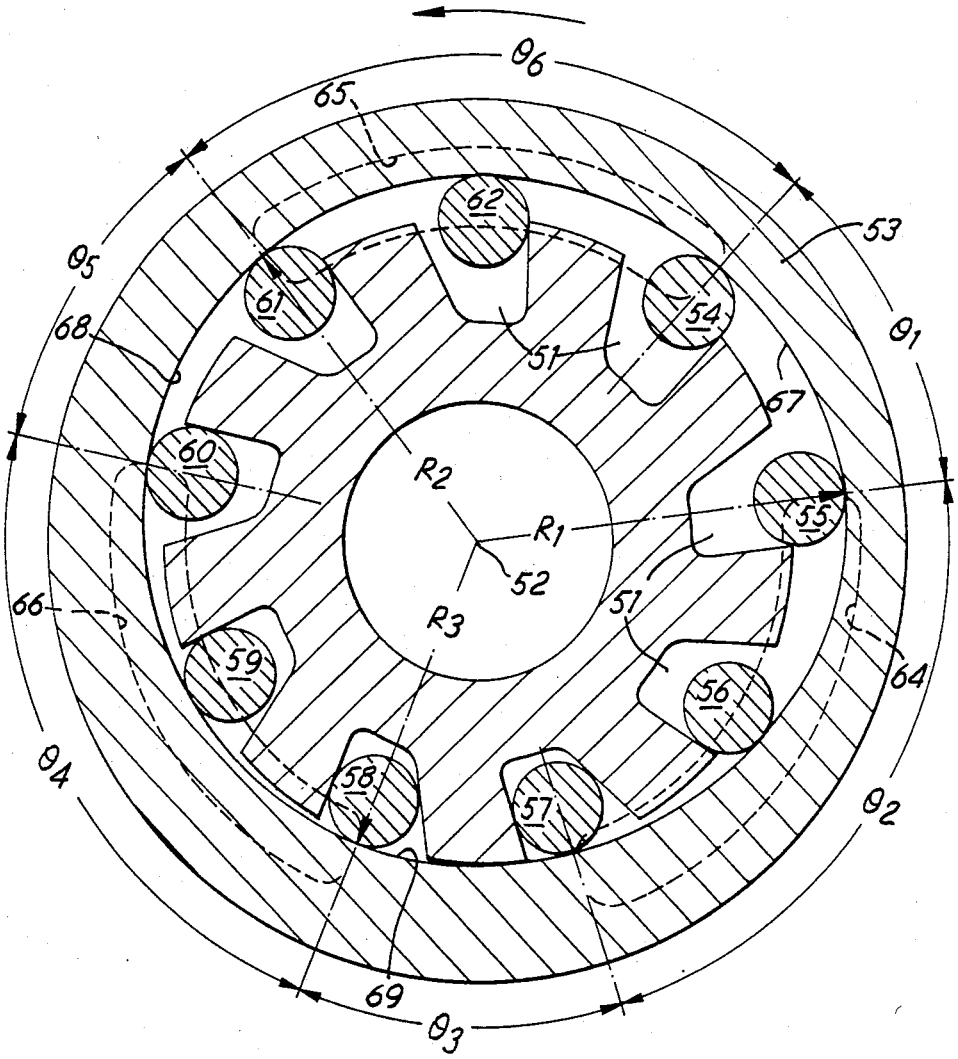

Two embodiments of the invention will now be described by way of example with reference to the accompanying diagrammatic drawings in which:

FIG. 1 is an axial section of a first embodiment of a rotary pump according to the invention; and FIG. 2 is an axial section of a second embodiment thereof.

Referring to the drawings, The rotary pump shown is of the kind known as a roller pump and comprises a rotor 10 having in its periphery radially extending slots 11 which are equiangularly spaced about the axis of rotation 20 and in which are disposed rollers 12*a* to 12*f* respectively. The rollers are urged outwardly by centrifugal force into rolling engagement with the internal surface of a housing 13 surrounding the rotor, which surface is a cam surface controlling the inward and outward movement of the rollers as the rotor rotates. The rotor rotates anticlockwise as viewed in the drawing.

In the construction illustrated in FIG. 1, an end member 13*a* of the housing provides an inlet port 14 and two outlet ports 15, 16 circumferentially spaced apart about the axis of the rotor and sealed with respect to each other. The adjacent edges of each adjacent pair of the ports are spaced apart by a distance not less than the distance between the points of contact of each pair of adjacent rollers with the cam surface, so that there is always at least one roller disposed between the said edges and forming a seal between them. There are thus three sealing arcs 17, 18, 19 of the cam surface separating the three ports and of angular extent $\theta_1$, $\theta_5$ and $\theta_3$ respectively. Each of these sealing arcs is of circular profile centred on the axis of rotation 20 of the rotor, and the radii of these arcs are shown as $R_1$, $R_2$ and $R_3$ respectively, $R_1$ being the radius of arc 17 extending through angle $\theta_1$ between the inlet port 14 and the first outlet port 15, $R_2$ being the radius of arc 18 through angle $\theta_5$ extending between the two outlet ports 15, 16 and $R_3$ being the radius of arc 19 through angle $\theta_3$ extending between the second outlet port 16 and the inlet port 14. Between arcs 19 and 17, i.e. over an arc 21 corresponding to the angular extent $\theta_2$ of the inlet port, the radius of the cam surface increases progressively, drawing liquid from the inlet port into the space between adjacent pairs of rollers 12, but may at the beginning of arc 17 have a value slightly greater than $R_1$ and then decrease, so as to provide a degree of pre-compression of the pumped liquid over the extent of arc 17. Arc 17, being of circular profile centred on axis 20, provides a dwell. Over the angular extent $\theta_6$ of the first outlet 15, the radius of the cam surface decreases progressively to $R_2$, then arc 18 provides a second dwell of constant radius $R_2$, followed by a further progressive decrease of radius of the cam surface to $R_3$ over a cam surface arc 23 corresponding to the angular extent $\theta_4$ of the second outlet 16, and arc 19 then provides a third dwell of constant radius $R_3$.

Each of the ports instantaneously is sealed off from the other ports by two rollers which are in contact with the sealing arcs flanking the port.

Thus in the instantaneous position of the rotor shown in the drawing, port 14 is sealed by rollers 12*a* and 12*c* (roller 12*b* being ineffective for that purpose) but 12*c* is also about to become a non-sealing roller and port 14 will then be sealed by rollers 12*a* and 12*d* and the instantaneous difference in the radii of their points of contact with the cam surface will then determine the instantaneous increase in volume open to the inlet port and hence the rate of flow of fluid through the inlet port. Similarly, port 15 is sealed by rollers 12*a* and 12*f* which therefore determine the flow through the port 15, and port 16 is sealed by rollers 12*e* and 12*d* which therefore determine the flow through port 16. If the rotor had a larger number of rollers, the length of arcs 17, 18 and 19 would be reduced and the number of non-sealing rollers (i.e. rollers in contact with the arcs 21, 22, 23) at any instant would be greater than in the illustrated construction.

Ports 14, 15 and 16 are respectively in permanently open communication, through passages (not shown) in the end member 13*a*, with ports 14*a*, 15*a* and 16*a*. Ports 14*a*, 15*a* and 16*a* are opened and closed substantially simultaneously with their respective associated ports 14, 15 and 16.

The instantaneous volume of liquid pumped through the first outlet 15 for a pump of axial length L is $$\pi(R_1^2-R_2^2)\times L\times \text{speed of rotation}$$

For a given output and a given value of $R_1$, the required value of $R_2$ can therefore be calculated.

Similarly the instantaneous volume of liquid pumped through the second outlet 16 is $$\pi(R_2^2-R_3^2)\times L\times \text{speed of rotation}$$

so that for a given output at the second outlet port, $R_2$ having been determined, $R_3$ can be calculated. In the design shown in FIG. 1 $R_1$ is kept constant and hence $R_2$ and $R_3$ are also constant.

The connecting arc 22 between sealing arcs 17 and 18 may, as in the case of arc 21 described above, provide a degree of over-filling and consequential precompression of the liquid over the length of the sealing arc 18.

Where the second of the outputs is at low pressure, e.g. only slightly above atmospheric pressure, the sealing arc 19 may vary, if desired, from the circular profile described above, since the noise level at low pressure deliveries is less pronounced than at high pressure deliveries.

In the arrangement shown in FIG. 2, another form of roller pump according to the invention is shown. A rotor 50 with equiangularly spaced slots 51 in its periphery rotates about an axis 52 within a fixed housing 53, and rollers 54 to 62 in the slots engage a cam surface provided by the internal surface of the housing. An end member 63 of the housing has formed in it an inlet port 64 and two outlet ports 65, 66 spaced about the axis 52. Three sealing arcs 67, 68, 69 of the cam surface separate the three ports and co-operate with the rollers to form seals between the ports. Thus, in the position shown, rollers 55 and 57 seal the inlet port 14, rollers 54 and 61 seal the first outlet port 15, and rollers 60 and 58 seal the second outlet port 16, while rollers 56, 62 and 59 are temporarily idle in this respect, but rotation of the rotor beyond the position shown will cause the inlet port 14 to be sealed by rollers 55 and 58, outlet port 15 to be sealed by roller 61 and 55, and outlet port 16 to sealed by rollers 58 and 61. As in the arrangement of FIG. 1, the angular extents of the inlet port and the first and second outlet ports are $\theta_2$, $\theta_6$ and $\theta_4$ respectively, and the three sealing arcs are of angular extent $\theta_1$, $\theta_5$ and $\theta_3$ respectively. Each of the sealing arcs in this construction is of decreasing radius along its length in the direction of rotation of the rotor indicated by the arrow. The instantaneous radii of the three sealing arcs at the points of contact therewith by rollers 55, 61 and 58 are given by $R_1$, $R_2$, and $R_3$ respectively.

Thus, since $R_1$ does not remain constant over the length of the sealing arc, but gradually decreases as in this example thereby ensuring that the roller always remains in contact, then $R_2$ will also vary such that the instantaneous value of $R_2$ satisfies the formula:

$$\pi(R^2{}_1-R^2{}_2)\times L\times \text{speed}=K_1 \text{ (constant)}$$

hence keeping this instantaneous delivery from outlet No. 1 constant and again having determined $R_2$ by this means, $R_3$ can be determined from the formula:

$$\pi(R^2{}_2-R^2{}_3)\times L\times \text{speed}=K_2 \text{ (constant)}$$

hence keeping the instantaneous delivery from outlet No. 2 constant.

Keeping the instantaneous delivery constant reduces the noise level from the pump.

The slots for the rollers in the pump shown in the drawings are divergent in an outward direction and the second output pressure at the second outlet should be higher than at the first outlet in order to avoid movement of the rollers across the width of the slots, but the slots may be parrallel-sided. The invention is equally applicable to sliding vane pumps and other radially-moving piston type rotary pumps. The invention is also applicable to pumps of the kind referred to having an inlet port and more than two outlet ports spaced circumferentially and sealed from each other.

I claim:

1. A rotary pump comprising:

a housing having a circumferentially extending cam surface on the inner surface thereof;

a rotor in said housing and provided with radial slots;

piston means in each of said slots and movable radially in the slots and engaging said circumferentially extending cam surface;

said housing further having an inlet port and at least two outlet ports circumferentially spaced from each other and from said inlet port, whereby rotation of the rotor causes fluid from the inlet port to be delivered to said outlet ports, the profiles of the two portions of said cam surface extending circumferentially on opposite sides of at least one of the outlet ports along which two piston means move respectively for jointly carrying out the instantaneous delivery through said one outlet port, having radii relative to the axis of rotation of said rotor which decrease progressively in the direction of rotation of said rotor, and the difference between the squares of the radii of said two portions relative to the axis of rotation of the rotor at the instantaneous points of contact of said two piston means with the two portions respectively is a constant.

* * * * *